US005426823A

United States Patent [19]

Feller et al.

[11] Patent Number: 5,426,823

[45] Date of Patent: Jun. 27, 1995

[54] METHOD AND APPARATUS FOR ON-LINE QUALITY MONITORING IN THE PREPARATORY APPARATUS OF A SPINNING MILL

[75] Inventors: Peter Feller, Benglen; Walter Grüebler, Aathal-Seegräben, both of Switzerland

[73] Assignee: Zellweger Luwa, Uster, Switzerland

[21] Appl. No.: 182,703

[22] Filed: Jan. 13, 1994

[30] Foreign Application Priority Data

Jan. 13, 1993 [CH] Switzerland ..... 00082/93

[51] Int. Cl.[6] ..... D01G 31/00

[52] U.S. Cl. ..... 19/239; 19/0.23

[58] Field of Search ..... 19/0.20, 0.22, 0.23, 19/239; 364/470

[56] References Cited

U.S. PATENT DOCUMENTS

| | | | |
|---|---|---|---|
| 4,100,649 | 7/1978 | Erismann et al. | 19/0.2 |
| 4,766,647 | 8/1988 | Ackermann, Jr. et al. | 19/0.22 |
| 4,864,853 | 9/1989 | Grunder et al. | 19/240 X |
| 4,962,569 | 10/1990 | Hösel | 19/0.23 X |
| 5,010,494 | 4/1991 | Lord | 19/239 X |
| 5,134,755 | 8/1992 | Jornot et al. | 19/239 |
| 5,194,911 | 3/1993 | Stutz | 19/0.23 X |
| 5,248,925 | 9/1993 | Jornot | 19/239 X |

FOREIGN PATENT DOCUMENTS

| | | | |
|---|---|---|---|
| 5247712 | 9/1993 | Japan | 19/0.23 |

*Primary Examiner*—John J. Calvert

[57] ABSTRACT

The fluctuations in cross-section of fiber slivers are detected by means of a sensor, and from these detections are derived quality parameters, one of which is based on mass non-uniformity. Measurement signals are compared with a limit value for deviations from the desired weight of the monitored sliver, which limit value is formed as a product of mass non-uniformity and a selectable limit-value factor. Any measurement exceeding the limit value is interpreted as the presence of a thick place in the fiber sliver.

12 Claims, 1 Drawing Sheet

METHOD AND APPARATUS FOR ON-LINE QUALITY MONITORING IN THE PREPARATORY APPARATUS OF A SPINNING MILL

FIELD OF THE INVENTION

The present invention relates to on-line quality monitoring in the preparatory apparatus of a spinning mill by measuring fluctuations in cross-section of slivers, and by deriving quality parameters from the measurement signal thus obtained, where one of the parameters comprises mass non-uniformity and deviations of the quality parameters from selectable limit values are detected.

BACKGROUND OF THE INVENTION

On-line measurement of this type is used, for example, in the data system of the USTER SLIVERDATA (USTER is a registered trademark of Zellweger Uster AG) which is employed to monitor quality and production in the preparatory apparatus of a spinning mill. Within the scope of quality monitoring, the silver count and periodic and virtually periodic mass fluctuations are checked, in addition to mass non-uniformity.

It is known that most faults influencing the quality of the final product are caused by fluctuations in the silver count, silver non-uniformity, periodic mass fluctuations and drafting faults. In addition to this certain knowledge, it may be assumed that, on the basis of practical experience, short thick places also cause duality problems. This is because thick places of such a kind lead to cost-intensive disruptions in production and, moreover, influence the quality of the final product and the efficiency of all of the process steps.

It has hitherto been possible to detect short thick places only by laboratory tests. These short thick places arise as a result of sliver accumulations, defective machine parts, inadequate maintenance and cleaning and incorrect machine settings, and can occur very frequently. Bearing in mind that 50 bobbins of yarn or more can be manufactured from the quantity of sliver produced in only one minute on a modern high-performance drafting frame, it becomes clear that the laboratory test cannot prevent serious losses of quality. Such a goal is possible only by way of on-line monitoring.

OBJECT OF THE INVENTION

It is an object of the present invention, therefore, to provide a method and system for on-line monitoring in the preparatory apparatus of a spinning mill, which allows the detection of short thick places.

SUMMARY OF THE INVENTION

The foregoing object is achieved, according to the invention, by comparing the measurement signals with a limit value for the deviations from the desired weight of the monitored sliver, which limit value is formed as a product of the mass non-uniformity and a selectable limit-value factor. Any section of the fiber sliver whose measurement exceeds the limit value is interpreted as a thick place.

The method according to the invention allows the reliable detection of thick places having a specific length and a specific cross-section. The length depends on the speed at which the sliver is being fed and the sensing frequency. In a typical exemplary embodiment, the length of a detectable thick place can be around 4 cm. However, this does not mean that thick places of smaller length would not be detected. Rather, for shorter lengths the detection would simply have less than 100% accuracy. The advantage of basing the limit value on the mass non-uniformity is that the thick places are defined not in terms of their absolute cross-section, but rather in terms of the relative increase in cross-section in percentages of the desired sliver weight. More precisely, those thick places which cause a recognizable fault in the fabric, that is to say usually shading, are detected in this way.

It was previously possible, under certain circumstances, to recognize thick places of this kind in a visual check by operating personnel. It is virtually no longer possible today. In particular, this is due to the increased production speed and to the fact that it is becoming increasingly common for machines for producing slivers, such as drafting frames, cards and combing machines, to be completely encased, with the result that a visual sliver check is no longer possible. On the other hand, the number of short thick places tends to increase with an increase in production speed, because these features are mainly caused by faults on machine parts and suction systems and by an uncontrolled wear of machine elements to be maintained. These faults and this wear increase with an increase in production speed.

The invention relates further to an apparatus for carrying out the method, with a sensor for sensing the sliver cross-section and with an evaluation unit for processing the sensor signals, which has a first channel for determining the mass non-uniformity. In the apparatus according to the invention, the evaluation unit has a second channel for analyzing the sensor signals to determine whether they exceed a first adjustable limit value, which corresponds to an increase in cross-section of the sliver, and the size of which is also determined by the mass non-uniformity determined in the first channel.

BRIEF DESCRIPTION OF THE DRAWINGS

The invention is explained in more detail below by means of an exemplary embodiment illustrated in the drawings.

DETAILED DESCRIPTION OF THE PREFERRED EMBODIMENT

Figure 1:
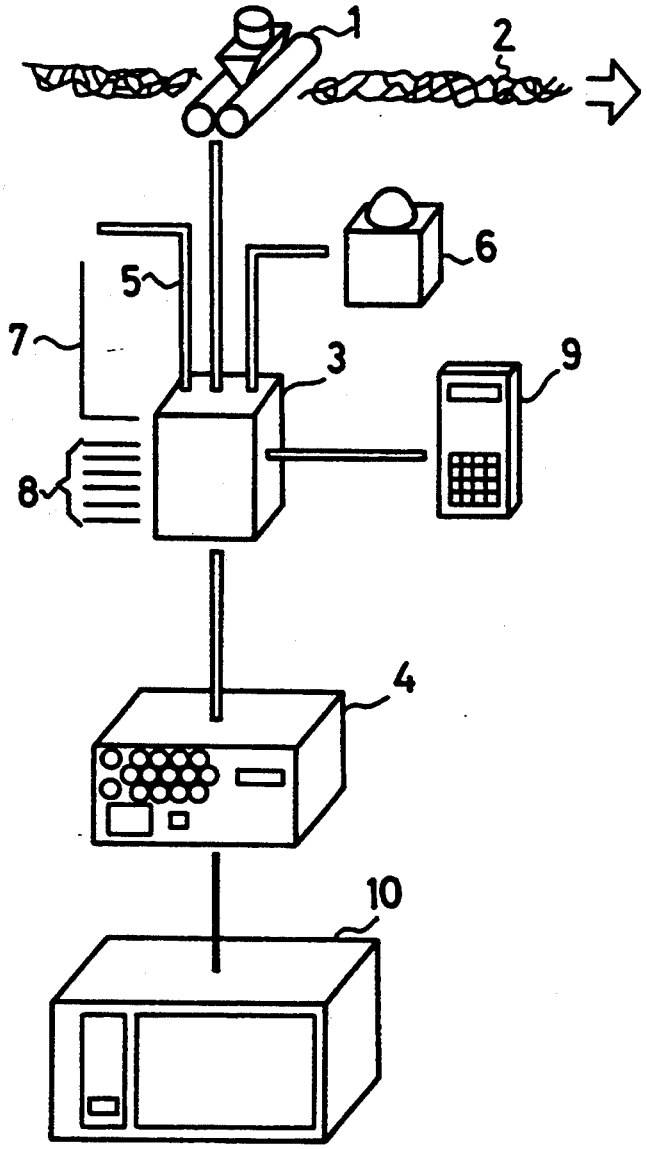
FIG. 1 shows a diagrammatic representation of a system for on-line quality monitoring in the preparatory apparatus of a spinning mill.

To facilitate an understanding of the invention, a known system of the type in which it can be employed will first be described. FIG. 1 shows the structure of an USTER SLIVERDATA system for monitoring production and quality in the preparatory apparatus of a spinning mill. A measuring member 1 for detecting fluctuations in cross-section of the monitored fiber sliver 2 is arranged, for each delivery line, on the machine to be monitored for the production of a fiber sliver, for example, on a card, drafting frame or combing machine. Since the measuring member itself is not a subject of the present invention, it is not explained in detail here. For further information regarding such a device, attention is drawn to U.S. Pat. No. 4,864,853, in which a preferred measuring member for fluctuations in sliver cross-section is described.

The measurement signal from the measuring member 1 is connected to a processor 4 via a so-called machine station 3. A common processor 4 can be provided for a group of measuring members 1, up to sixteen in number. The machine station 3 also possesses, in addition to the input for the measurement signals from the measuring member 1, an input for signals fed by way of a line 5 from a production sensor (not shown), which serves to record speed as well as running and stopping times. This recording takes place by monitoring the rotational speed of a shaft, such as, for example, a delivery cylinder or calendar, that rotates in proportion to the production speed.

The signals from the production sensor likewise pass via the machine station 3 into the processor 4, which calculates quality and production data from the measured values recorded for the individual deliveries, compares this data with limit values set by the user, and, if a limit value is exceeded, activates the competent machine station 3, whereupon the latter initiates a corresponding action. This action is either the activation of a warning lamp 6 in the event of minor, albeit acceptable faults or, by way of a line 7, the emission of a stop signal for stopping the machine in the event of serious faults.

As illustrated, each machine station 1 also has stop connections 8 for automatically recording the cause of a standstill by means of machine signals, and a connection for a so-called numerical machine terminal 9. The latter device is an input and output station, via which various codes can be input and data retrieved.

The processor 4 is connected to a central unit 10, the essential functions of which are to interrogate the processors periodically, process and store the measured values and machine signals, control the dialogue with the users and output data to higher-level systems. Video and/or printer terminals (not shown) connected to the central unit 10 serve as dialogue stations.

The quality data calculated by the processor 4 is as follows:

mass non-uniformity (coefficient of variation of the sliver count) in CV%;

spectrogram of the mass fluctuations to indicate periodic and non-periodic drafting faults;

average sliver-count deviation from a desired value (weight) in A%.

To enable the system to be used as a warning system, warning limits are entered for each of the quality parameters, and when these are exceeded, a warning lamp 6 (FIG. 1) begins to flash at the corresponding delivery line. In addition to the warning limits, a stop factor greater than one is also entered, and this is used to stop the machine when the measured parameter exceeds the warning limit times stop factor.

The coefficient of variation is averaged over the total analysis length of the spectrogram. For this purpose, the spectrograms of the individual delivery lines are determined in succession by the processor 4. This value is periodically updated, the interval between the individual updates depending on the train of machines and being, for example, between 15 minutes and several hours.

As is known, periodic faults and virtually periodical faults, so-called drafting waves, can be recognized from the spectrogram; the former by means of chimneys and the latter by means of hills. To analyze the spectrogram, the latter is subdivided into test regions, and for each region it is determined, by means of filters and warning limits, whether to trigger a warning in response to a fault magnitude of a hill or chimney. Monitoring is based essentially on a comparison of the values in the test region or test window with values obtained from the so-called base windows surrounding the test window. The warning is triggered when the ratio of the values in the test window to those in the base windows becomes higher than the warning limit.

A series of production data calculated by the central unit 10 is also added to the quality data calculated by the processor 4. Production data of this kind includes, for example, the number of doffings or sliver can changes, actual efficiency, quantity produced, theoretically possible production per hour at 100% efficiency, time per doffing or sliver can change, number of machine standstills, total stop time, measured delivery speed.

Figure 2:
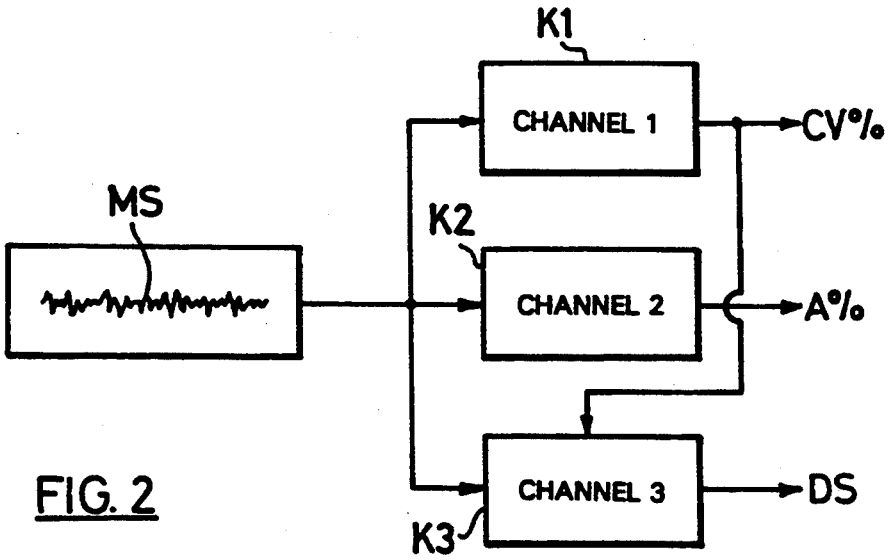
FIG. 2 shows a representation, in the form of a block diagram, of the signal processing to detect short thick places.

The monitoring of the sliver feed to detect short thick places, in accordance with the present invention, takes place within the machine station 3. Referring to FIG. 2, the machine station 3 processes the measurement signal MS from the measuring member 1 in three channels. In a first channel K1, the coefficient of variation of the sliver count for short fluctuations is determined in a known manner to produce an output value CV%; in a second channel K2, the sliver-count deviation from the desired value is determined as a value A%, and in a third channel K3, monitoring of short thick places DS takes place. This double calculation, based on the previous configuration of an USTER SLIVERDATA system, of the coefficient of variation and sliver-count deviation in the processor 4, on the one hand, and in the machine station 3 on the other hand, is not essential to the present invention. The values for CV% and A% can be obtained from the processor 4. Alternatively, the double calculation can be avoided by integrating the functions of the processor 4 into the machine station 3.

In the first channel K1, fluctuations of the sliver count of a cut length of approximately 4 cm within sliver pieces of 100 m are measured. In the second channel K2, which in contrast to the channel K1 is a long-term channel, the sliver-count deviation from the desired value is measured, the measuring member 1 (FIG. 1) being calibrated to this desired value whenever the processed articles or materials and the sliver count are changed. The deviations of the sliver count from the desired value are integrated, so that the variation over time of the sliver count is calculated and stored in the channel K2.

In the third channel K3, a monitoring of the fiber sliver 2 (FIG. 1) in respect of short thick places DS, that is to say periodically occurring increases in cross-section of a specific size, takes place. The thick places, which can occur in large numbers, arise as a result of sliver accumulations, defective machine parts, inadequate maintenance and cleaning and incorrect machine settings. They cause disruptions in production which are highly cost-intensive, and, moreover, they influence the quality of the final product and the efficiency of all of the process steps.

It has hitherto been possible to detect short thick places only by way of laboratory tests, that is to say off-line, but this is insufficient in practice. This is because, in sliver sorting per layer, only 0.02% of the material produced is inspected in the laboratory, so that the results of laboratory tests are no longer statistically representative of the entire production. In addition, 50 bobbins of yarn or more can be manufactured from the quantity of sliver produced in only one minute by a modern high-performance drafting unit.

To record the thick places DS, a thick place is first defined as a specific increase in cross-section relative to the desired value, for example as an increase in cross-section of at least 40%, and a limit value for the deviation from the desired sliver weight is established. This establishment of the limit value takes place by forming the product of a factor K times the average non-uniformity CV% calculated in the channel K1. The factor K itself depends on how many times the limit value can be exceeded per 100 m of sliver. The higher the value K, therefore, the fewer the number of times that the limit can be exceeded.

In this respect, the desired sliver weight is not static, but rather a dynamic quantity. In the operating state, the average value of the sliver weight over the last 100 m is calculated in each case, and the working point of the system is thereby determined. If this working point, that is to say the average value, deviates from the desired sliver weight, then the limit value is corrected accordingly.

In order to make the system as user-friendly as possible, a plurality of different settings, for example, eight detecting alternatives, is established, and from these the user can select the one which seems the most suitable for the current situation. The user consequently need not input a plurality of numerical values, but it is sufficient to input the respective detecting alternative, for example by means of a digit or a letter.

The following Table 1 gives an example of how the detecting alternatives can be set up:

TABLE 1

| EV | GN | GA | Km |
|---|---|---|---|
| 1 | 1 | 5.0 · CV% | 100 |
| 2 | 1 | 5.4 · CV% | 1,000 |
| 3 | 1 | 5.8 · CV% | 10,000 |
| 4 | 2 | 4.7 · CV% | 10,000 |
| 5 | 5 | 3.7 · CV% | 10,000 |
| 6 | 10 | 3.2 · CV% | 10,000 |
| 7 | 20 | 2.9 · CV% | 10,000 |
| 8 | 50 | 2.3 · CV% | 10,000 |

In the first column of the table, eight detecting alternatives EV are given; the second column contains the associated limit values GN for the number of times the limit value is permitted to be exceeded over 100 m of sliver; and the third column contains the values GA (GA=K times CV%) for the deviation from the desired sliver weight (or from the average value of the sliver weight over 100 m). Finally, the fourth column indicates over how many kilometers of sliver the machine can be stopped one time or an alarm can be triggered as a result of normal statistical fluctuations in non-uniformity.

In alternatives 1 to 3, where GN=1, the machine is stopped each time the limit is exceeded, with the probability of a stop as a result of the normal statistical fluctuations in non-uniformity being between 100 and 10,000 km of sliver. In the remaining alternatives, a limit value GN of 2, 5, 10, 20 or 50 is used for the number of overlimit conditions. In this case, the probability of a stop as a result of the normal statistical fluctuations in non-uniformity is per 10,000 km of sliver. In operation, the machine station counts the number of times a thick place is detected over a given length of the sliver being monitored, and triggers an alarm condition, e.g. actuates a warning light and/or stops the machine, when the limit number GN is reached.

An example of the establishment of a limit value for thick places DS is given below:

It is assumed that the detecting alternative EV is 3; the desired sliver weight=Nm 0.28 (corresponding to 3.57 g/m), and CV%=3. The deviation value GA is calculated as GA=5.8×CV%=5.8×3%=17.4%.

The limit value is therefore 3.57×17.4%=0.62 g/m. The absolute limit value is equal to the desired sliver weight plus the limit value and this gives 3.57+0.62=4.19 g/m (around the desired sliver weight).

The limit value for thick places DS therefore amounts to 4.19 g/m in the present case. If this limit value is exceeded once over a length of 100 m of sliver, the machine is stopped. An alarm without a stop is triggered if the limit value is a few per cent lower.

The operating conditions of the system are such that the fiber sliver 2 is sensed 420 times per second, and the measured values are averaged over sliver lengths of 4 cm. This gives, at a maximum delivery speed for the foreseeable future of 1000 m per minute, at least one, and at lower delivery speeds, more than one, measured value per 4 cm of sliver length. This means, in turn, that thick places with a length of 4 cm are recorded with a certainty of 100%. Statistical analyses show that even substantially shorter thick places with a length of only 1 cm are still recorded with a probability of 40%.

If the detecting alternative EV, once selected, is too sensitive, the existing limit can be broadened individually by the input of additional percentages. If, for example, in alternative 3 the CV is equal to 3.1%, then the deviation value GA amounts to 18%. An input of +6% then gives a new limit of 24%. The inputs and indications of the setting alternatives EV and the input of additional percentages take place by means of the numerical machine terminal 9 (FIG. 1).

What is claimed is:

1. A method for monitoring the quality of fiber slivers on line in preparatory apparatus of a spinning mill, comprising the steps of:

measuring fiber slivers and generating a signal indicative of fluctuations in cross-sectional dimension of fiber slivers;

deriving quality parameters from such measurements, where one of said parameters is related to mass-nonuniformity;

determining a limit value as a product of mass-nonuniformity and a limit-value factor;

comparing the measurement results with a desired weight for the sliver being monitored to determine a deviation value; and initiating a corresponding action each time the deviation value exceeds said limit value.

2. The method of claim 1 wherein said desired weight comprises the average weight of the sliver over a predetermined length thereof.

3. The method of claim 2 wherein said predetermined length is 100 meters.

4. The method of claim 1 further including the steps of:

counting a number of times that said limit value is exceeded over a predefined length of fiber sliver;

comparing the counted number with a limit number; and wherein the step of initiating includes triggering an alarm condition if the counted number exceeds the limit number.

5. The method of claim 4 wherein the step of triggering an alarm condition includes stopping the operation of a machine for processing the monitored fiber sliver.

6. The method of claim 4 wherein said limit-value factor is determined with respect to normal statistical fluctuations of fiber sliver such that the probability of an alarm triggering is once per said predefined length of fiber sliver.

7. The method of claim 4 further including the steps of:

determining a plurality of alternative selections for detecting thick places, where each selection includes an associated limit-value factor, limit value and limit number; and selecting one of said alternate selections to establish the limit value for detecting thick places.

8. The method of claim 7 further including the step of adding a percentage value to the limit value for one of said selections at the time said one selection is selected to establish the detection limits.

9. An apparatus for monitoring the quality of fiber slivers on line in preparatory apparatus for a spinning mill, comprising:

a sensor for measuring a cross-sectional dimension of fiber slivers as they are being fed to said preparatory apparatus;

first means responsive to measured values of the cross-sectional dimension for determining mass nonuniformity of the slivers;

second means responsive to said measured values for determining whether increases in the cross-sectional dimension of the slivers exceed an adjustable limit value which is based upon said mass nonuniformity and for initiating a corresponding action, providing an indication of when the limit value is exceeded.

10. The apparatus of claim 9, further including means for counting a number of thick places over a predefined length of fiber slivers, means for determining whether the counted number exceeds a limit number, and means for triggering an alarm condition when the counted number exceeds the limit number.

11. The apparatus of claim 10 wherein said triggering means stops the operation of a machine for processing the monitored fiber sliver.

12. The apparatus of claim 10 further including means storing a table containing a plurality of groups of related limits, and means for selecting one of said groups from said table.

* * * * *